United States Patent [19]

Katayama et al.

[11] Patent Number: 4,912,448

[45] Date of Patent: Mar. 27, 1990

[54] COIL DEVICE WITH COIL AND LEAD TERMINALS

[75] Inventors: Koji Katayama; Ikuo Maeda, both of Himeji, Japan

[73] Assignee: Mitsubishi Denki Kabushiki Kaisha, Tokyo, Japan

[21] Appl. No.: 416,580

[22] Filed: Oct. 3, 1989

[30] Foreign Application Priority Data

Oct. 4, 1988 [JP] Japan ..... 63-130564

[51] Int. Cl.[4] ..... H01F 15/10

[52] U.S. Cl. ..... 336/192; 439/888

[58] Field of Search ..... 310/71; 439/882, 889, 439/888, 890, 879; 336/192, 198, 208, 107

[56] References Cited

U.S. PATENT DOCUMENTS 3,350,679 10/1967 Marley et al. ..... 439/888 X
3,496,504 2/1970 Daley ..... 336/192 X
3,979,707 9/1976 Prince, Jr. ..... 336/192 X
4,649,361 3/1987 Horn et al. ..... 336/192
4,720,646 1/1988 Torimoto ..... 310/71

FOREIGN PATENT DOCUMENTS 186211 11/1986 Japan .
57555 4/1987 Japan .

*Primary Examiner*—Thomas J. Kozma
*Attorney, Agent, or Firm*—Sughrue, Mion, Zinn, Macpeak and Seas

[57] ABSTRACT

A coil device comprises a bobbin; one or more turns of wire wound on the bobbin to form a coil; coil terminals for leading out the coil by means of leads, the coil terminals having one end fixed on the bobbin and the other end formed in a hollow shape, respectively; end portions of the coil wound on the peripheral surfaces of the hollow parts of the coil terminals; and lead terminals fixed to the leads and inserted into the hollow parts to make electrical connection between the coil and the leads.

3 Claims, 4 Drawing Sheets

COIL DEVICE WITH COIL AND LEAD TERMINALS

BACKGROUND OF THE INVENTION

1. Field of the Invention

The present invention relates to a coil device wherein a coil formed by winding one or more turns of wire on a bobbin is led out by means of leads.

2. Discussion of Background

In FIGS. 10 through 12, there is shown a conventional coil device as e.g. disclosed in Japanese Unexamined Utility Model Publication No. 27006/1988. In these Figures, reference numeral 1 designates a bobbin which has flanges 1*a* and 1*b* at both ends, and which has a flange 1*c* at a position between the flanges 1*a* and 1*b* and near to the flange 1*b* to form a predetermined gap 2 with the flange 1*b*. Reference numeral 3 designates a coil which is formed by winding one or more turns of wire on the bobbin 1, and whose peripheral surface is protected by an insulating member 4. End portions 3*a* and 3*b* of the coil 3 are wound directly on leading conducting parts of leads 5*a* and 5*b*, and are soldered on them for electrical connection between the coil 3 and the leads 5*a* and 5*b*. The connection portions are arranged in the gap 2 of the bobbin 1 for protection.

In the conventional coil device constructed as abovementioned, the electrical connection between the coil 3 and the leads 5*a* and 5*b* has been made by winding the end portions 3*a* and 3*b* of the coil 3 on the leading conducting parts of the leads 5*a* and 5*b* and soldering the end portions on the leading conducting parts. During such connection work, an external force is likely to be applied to the coil 3. As a result, the coil 3 can be easily broken, which creats problems wherein reliability can be lowered and yield can be deteriorated. It is difficult to automate such connection work, and it takes a long time to complete the work, inviting an increase in cost.

SUMMARY OF THE INVENTION

It is an object of the present invention to solve such problems and to provide a new and improved coil device capable of improving reliability and decreasing cost.

The foregoing and other objects of the present invention have been attained by providing a coil device comprising a bobbin, hollow coil terminals fixed to the bobbin, a coil having end portions wound on the peripheral surfaces of hollow parts of the coil terminals, and lead terminals inserted into the hollow parts to make electrical connection. As a result, an external force can not be applied to the coil during work for making such electrical connection, thereby to prevent the coil from being broken, and to improve reliability. In addition, it is easy to automate work for winding the end portions of the coil on the coil terminals, and for making the electrical connection, allowing the time required for the works to be remarkably shortened, and cost to be decreased.

BRIEF DESCRIPTION OF THE DRAWINGS

A more complete appreciation of the invention and many of the attendent advantages thereof will be readily obtained as the same becomes better understood by reference to the following detailed description when considered in connection with the accompanying drawings, wherein.

DESCRIPTION OF THE PREFERRED EMBODIMENTS

Figure 1:
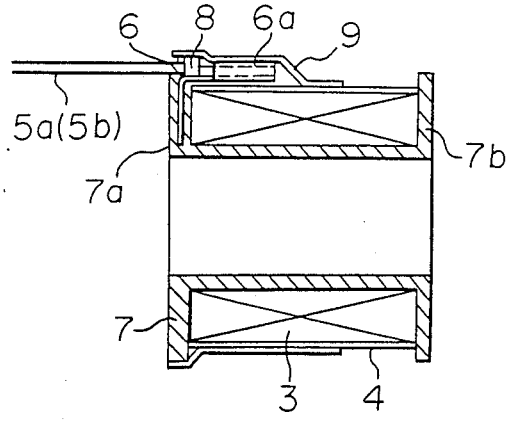
FIG. 1 is an axial sectional view of an embodiment of the coil device according to the present invention.

The present invention will be described in detail with reference to preferred embodiments illustrated in FIGS. 1 through 9. In these Figures, reference numeral 6 designate a coil terminal which has one end fixed in one of flanges 7*a* and 7*b* of a bobbin 7 (the flange 7*a* in the embodiment shown in FIG. 1) and the other end provided with a hollow part 6*a*. Reference numeral 8 designates a lead terminal which has one end fixed to the leading conducting part of a lead 5*a* or 5*b* and the other end formed in a rectangular form in section. The other end is inserted in the hollow part 6*a* of the coil terminal 6.

Figure 2:
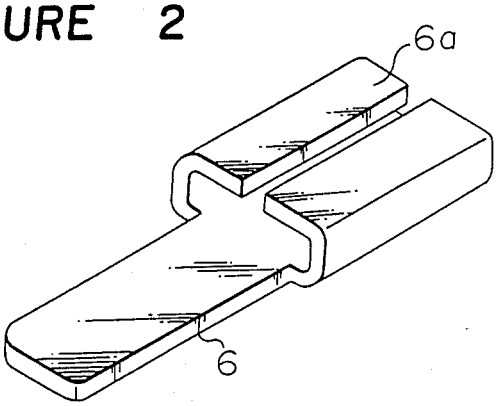
FIG. 2 is a perspective view showing a coil terminal used in the embodiment of FIG. 1.

As clearly shown in FIG. 2, the coil terminal 6 comprises a conductive stripped plate and the hollow part 6*a* arranged on one end of the plate. The coil terminal 6 can be made of a conductive stripped plate with a wider portion on its one end. The hollow part can be formed by bending opposed edges of the wider portion to make the edges face each other.

Figure 3:
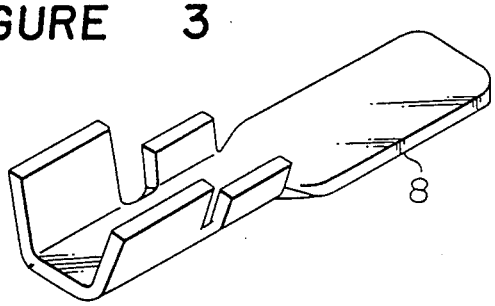
FIG. 3 is a perspective view showing a lead terminal used in the embodiment of FIG. 1.

As clearly shown in FIG. 3, the lead terminal 8 comprises a conductive stripped plate and two clip parts arranged on one end of the plate. The lead terminal 8 can be made of a conductive stripped plate with two wider portions on its one end. The clip parts can be formed by bending opposed edges of the wider portions to make the edges face each other.

The lead terminal could have one clip part or more than two clip parts.

In the coil device according to the present invention, a pair of such lead terminals, and a pair of such coil terminals are utilized. On the peripheral surfaces of the hollow parts 6*a* of the lead terminals, end portions 3*a* and 3*b* of the coil 3 are wound, and the end portions 3*a* and 3*b*, and the lead terminals 8 are soldered to the hollow parts 6*a*, respectively, to make electrical connection between the coil and the leads.

Reference numeral 9 designates an insulating member which is used to cover each coil terminal 6 and each lead terminal 8. Reference numeral 4 designates an insulating member which is used to cover the peripheral surface of the coil 3.

Next, a manufacturing process of the coil device constructed as above-mentioned will be explained.

Figure 4:
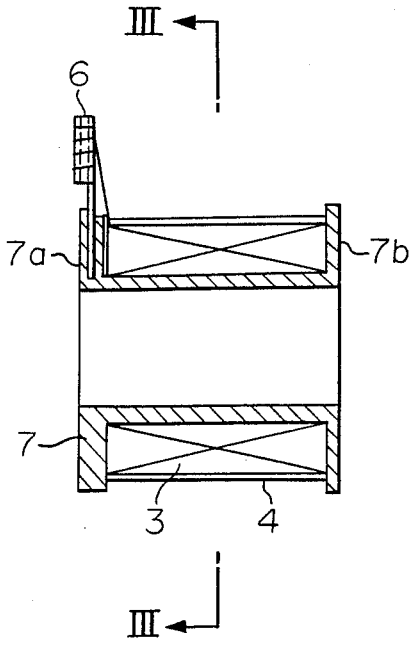
FIG. 4 is an axial sectional view showing the embodiment at the time of winding one or more turns of wire.
Figure 5:
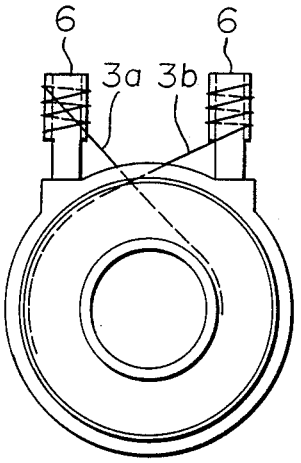
FIG. 5 is a sectional view taken along the line of III—III of FIG. 4.
Figure 7:
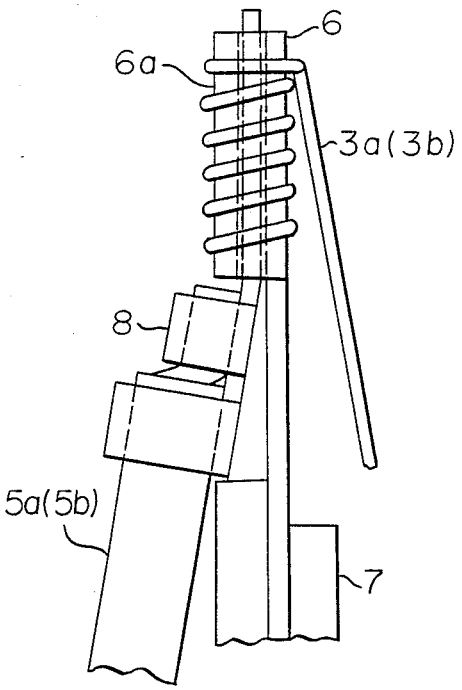
FIG. 7 is an enlarged view of a lead connection part of the embodiment.
Figure 6:
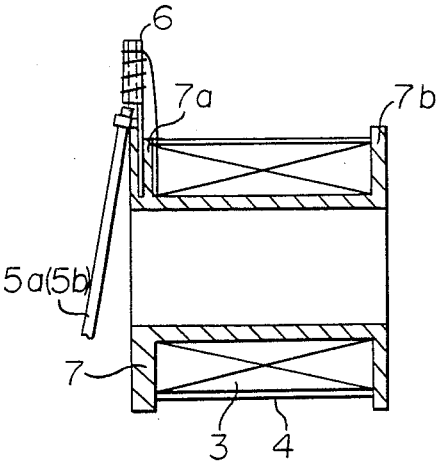
FIG. 6 is an axial sectional view showing the embodiment at the time of connecting leads to ending portions of the coil.
Figure 8:
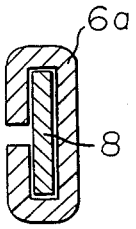
FIG. 8 is a sectional view showing how a lead terminal is inserted in a hollow part of the coil terminal of the embodiment.
Figure 9:
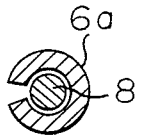
FIG. 9 is a sectional view showing how a lead terminal is inserted in a hollow part of the coil terminal in another embodiment.
Figure 10:
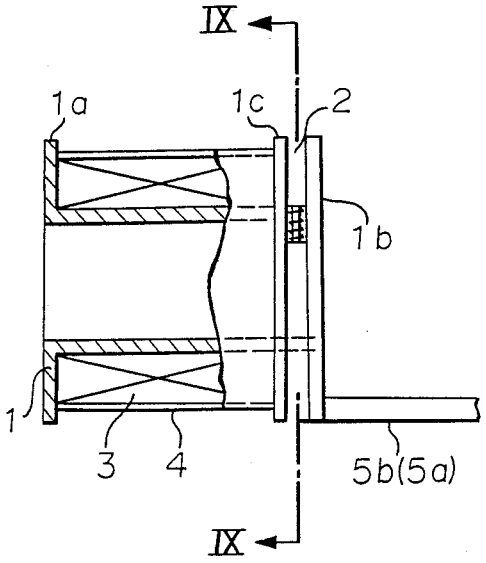
FIGURE 10 PRIOR ART
FIG. 10 is a front view wherein a part of a conventional coil device is show in section.
Figure 11:
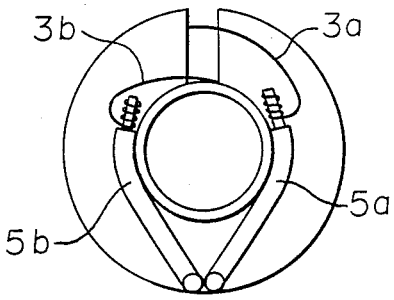
FIGURE 11 PRIOR ART
FIG. 11 is a sectional view taking along the line IX—IX of FIG. 10.
Figure 12:
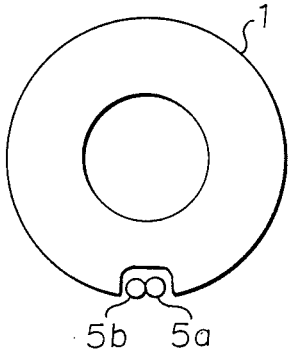
FIGURE 12 PRIOR ART
FIG. 12 is a side view showing the coil device of FIG. 10.

Firstly, the coil terminals 6 are fixed in the flange 7*a* of the bobbin 7, and one or more turns of wire are wound on the bobbin. As shown in FIGS. 4 and 5, the coil winding is made by winding a wind-starting end 3*a* of the coil 3 on the peripheral surface of the hollow part 6*a* of one of the coil terminals 6, and winding the wire on the bobbin 7 in a predetermined turns to form the coil 3, and then winding a wind-ending end 3*b* of the coil 3 on the peripheral surface of the hollow part 6*a* of the other coil terminal 6. In addition, on the peripheral surface of the coil 3, an insulating member 4 is wound. In this way, coil winding is completed. Secondly, as shown in FIGS. 6 through 8, the other ends of the lead terminals 8 with the leads 5*a*, 5*b* press-fitted therein are inserted into the hollow parts 6*a* of the coil terminals 6, respectively. The end portions 3*a* and 3*b* of the coil, the coil termianls 6, and the lead terminals 8 are simultaneously soldered for electrical connection. After that, the coil terminals 6 are bent over the insulating member 4 of the coil 3. In addition, the insulating member 9 is wound on the peripheral surface of the coil to cover the coil terminals 6 and the lead terminals 8. Thus, the coil device shown in FIG. 1 is completed.

Although in the embodiment just above-mentioned the sectional shape of the lead terminals 8 to be inserted into the hollow parts 6*a* is rectangular, that can be circular as shown in FIG. 7, offering an effect similar to the embodiment just above-mentioned.

Obviously, numerous modifications and variations of the present invention are possible in light of the above teachings. It is therefore to be understood that within the scope of the appended claims, the invention may be practiced otherwise than as specifically described herein.

What is claimed is:

1. A coil device comprising:

a bobbin;

one or more turns of wire wound on the bobbin to form a coil;

coil terminals for leading out the coil by means of leads, the coil terminals having one end fixed to the bobbin and the other end formed in a hollow shape, respectively;

end portions of the coil wound on the peripheral surfaces of the hollow parts of the coil terminals; and lead terminals fixed to the leads and inserted into the hollow parts to make electrical connection between the coil and the leads.

2. A coil device according to claim 1, wherein at least one of the hollow parts is rectangular in section.

3. A coil device according to claim 1, wherein at least one of the hollow parts is circular in section.

* * * * *